US009056735B2

(12) United States Patent
Tokoro et al.

(10) Patent No.: US 9,056,735 B2
(45) Date of Patent: Jun. 16, 2015

(54) IMAGE FORMING APPARATUS

(71) Applicants: Yuji Tokoro, Nagoya (JP); Yohei Hashimoto, Nagakute (JP)

(72) Inventors: Yuji Tokoro, Nagoya (JP); Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 3 days.

(21) Appl. No.: 13/851,133

(22) Filed: Mar. 27, 2013

(65) Prior Publication Data

US 2013/0320608 A1 Dec. 5, 2013

(30) Foreign Application Priority Data

May 30, 2012 (JP) ..... 2012-123388

(51) Int. Cl.

| | |
|---|---|
| ***B65H 5/34*** | (2006.01) |
| ***B65H 5/06*** | (2006.01) |
| ***B65H 3/06*** | (2006.01) |
| ***G03G 15/00*** | (2006.01) |

(52) U.S. Cl.

CPC ..... *B65H 5/068* (2013.01); *B65H 3/0676* (2013.01); *G03G 15/5008* (2013.01)

(58) Field of Classification Search

CPC ..... H04N 1/00602; H04N 1/00631; B65H 2801/06; B65H 5/025; B65H 29/68; B65H 2513/10; B65H 5/34; B65H 29/12; B65H 2403/724; B65H 2513/51; B65H 2513/514; B65H 2301/4474; B41J 13/103; G03G 15/60

USPC ..... 271/3.14, 4.01, 270

See application file for complete search history.

(56) References Cited

U.S. PATENT DOCUMENTS

| | | | | |
|---|---|---|---|---|
| 7,248,276 | B2 | 7/2007 | Suzuki | |
| 8,348,265 | B2 * | 1/2013 | Isogai | 271/242 |
| 2003/0038418 | A1 * | 2/2003 | Isemura et al. | 271/10.01 |
| 2005/0280378 | A1 | 12/2005 | Suzuki | |
| 2010/0295241 | A1 * | 11/2010 | Isogai | 271/227 |

FOREIGN PATENT DOCUMENTS

| | | | |
|---|---|---|---|
| JP | 9-99606 | * | 4/1997 |
| JP | 11-084790 | A | 3/1999 |
| JP | 2004-138840 | A | 5/2004 |

(Continued)

OTHER PUBLICATIONS

Machine translation of Detailed Description section of JP2008-90143.*

(Continued)

*Primary Examiner* — Thomas Morrison
(74) *Attorney, Agent, or Firm* — Banner & Witcoff, Ltd.

(57) ABSTRACT

An image forming apparatus including: first to third rotators, rotated in accordance with an image forming operation of an image forming section; a first motor driving the first and third rotators; a second motor driving the second rotator; a first switch switching between a connected state in which a driving force from the first motor is transmitted to the third rotator, and a disconnected state in which the driving force from the first motor is not transmitted to the third rotator; and a control device performing a first rotating process of rotating the first rotator by rotating the first motor in the disconnected state, performing a second rotating process of rotating the second rotator by rotating the second motor, and performing a start timing process of providing a difference between start timings of the first and second rotating processes.

17 Claims, 5 Drawing Sheets

(56) References Cited

FOREIGN PATENT DOCUMENTS

| | | | |
|---|---|---|---|
| JP | 2004-333807 | A | 11/2004 |
| JP | 2006-003755 | A | 1/2006 |
| JP | 2006-154250 | A | 6/2006 |
| JP | 2007-225655 | A | 9/2007 |
| JP | 2008-90143 | * | 4/2008 |

OTHER PUBLICATIONS

Machine translation of Detailed Description section of JP 9-99606.*

* cited by examiner

IMAGE FORMING APPARATUS

CROSS-REFERENCE TO RELATED APPLICATIONS

This application claims priority from Japanese Patent Application No. 2012-123388 filed on May 30, 2012, the entire contents of which are incorporated herein by reference.

TECHNICAL FIELD

Aspects of the present invention relate to an image forming apparatus, and more particularly, to a technique for suppressing a startup peak current when starting up motors in an image forming apparatus including a plurality of motors.

BACKGROUND

In an image forming apparatus including a plurality of motors, a technique for suppressing a startup peak current at the time of startup of the motors is described in, for example, JP-A-2004-138840. Specifically, a technique for reducing the startup peak current by providing a difference between the startup times of two motors is described therein.

However, due to an increase in electric power to achieve high performance of an apparatus and strictness in safety standards, more suppression in the startup peak current is required.

SUMMARY

An aspect of the present invention is to provide a technique for further suppressing a startup peak current when starting up a plurality of motors.

According to an aspect of the present invention, there is provided an image forming apparatus including: an image forming section; a first rotator, a second rotator, and a third rotator; a first motor; a second motor; a first switch; and a control device. The image forming section is configured to form an image on a sheet. The first rotator, the second rotator, and the third rotator are configured to be rotated in accordance with an image forming operation of the image forming section. The first motor is configured to drive the first rotator and the third rotator. The second motor is configured to drive the second rotator. The first switch is configured to switch between a connected state in which a driving force from the first motor is transmitted to the third rotator, and a disconnected state in which the driving force from the first motor is not transmitted to the third rotator. The control device is configured to: perform a first rotating process of rotating the first rotator by rotating the first motor in the disconnected state, perform a second rotating process of rotating the second rotator by rotating the second motor, and perform a start timing process of providing a difference between a start timing of the first rotating process and a start timing of the second rotating process.

Accordingly, since a difference is provided between the start timing of the first rotating process and the start timing of the second rotating process, and the second rotating process is performed while the first rotating process is performed in a state in which the first switch is in the disconnected state and the first motor is in a low load state, it is possible to suppress the peak current when the plurality of motors are started.

DETAILED DESCRIPTION

Hereinafter, an exemplary embodiment of the present invention will be described with reference to FIGS. 1 to 5.

1. Entire Configuration of Printer

Figure 1:
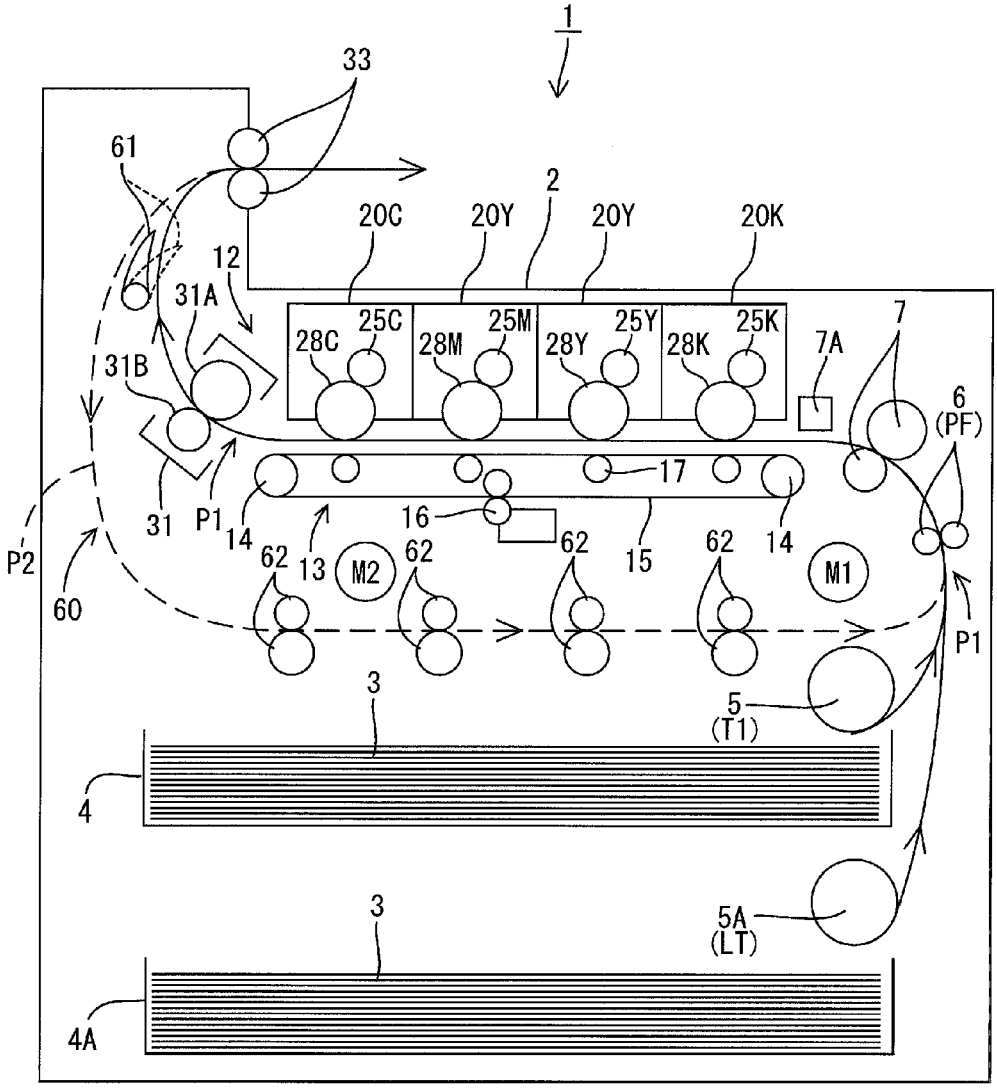
FIG. 1 is a side sectional view illustrating a schematic configuration of a printer according to an exemplary embodiment.

As illustrated in FIG. 1, a printer 1 is a color printer of a direct tandem capable of forming a color image using toners of four colors (black K, yellow Y, magenta M, and cyan C). In the following description, a right side in FIG. 1 refers to as a front side, and a left side refers to a rear side. Meanwhile, the image forming apparatus is not limited to the color printer of the direct tandem type, but, for example, may be applied to a monochromatic printer, or a multifunction machine having a copying function and a facsimile function.

The printer 1 includes a body casing 2, and a sheet feeding stray 4 and an optional sheet feeding tray 4A which are provided at a bottom portion inside the body casing 2 and on which a plurality of sheets 3 can be stacked. The optional sheet feeding tray 4A may not be provided. Pick-up rollers 5(T1) and 5A(LT) are respectively provided at an upper side of a front end portion of the respective sheet feeding trays 4 and 4A, and the uppermost sheet 3 placed in the sheet feeding trays 4 and 4A is delivered to a supply passage P1, which is provided at an inner front portion of the body casing 2, in accordance with rotation of the respective pick-up rollers 5 and 5A.

An auxiliary sheet feeding roller (PF) 6 and a registration roller 7 are provided in the supply passage P1. The registration roller 7 conveys the sheet 3 conveyed from the supply passage P1 onto a belt 15. Further, a registration rear sensor 7A for outputting a detected signal in accordance with the presence or absence of the sheet 3 is provided at a downstream side of the registration roller 7 in a sheet conveying direction.

An image forming section 12 includes a belt unit 13, an exposure section illustrated), a process unit 20, and a fixing unit 31.

The belt unit 13 has an annular belt 15 stretched between a pair of front and rear belt support rollers 14. As the rear-side belt support roller 14 is rotated, the belt 15 is circulated in a clockwise direction in the drawing, so that the sheet 3 carried on an upper surface of the belt 15 is conveyed rearward. Further, four transfer rollers 17 are provided at an inner side of the belt 15. The belt unit 13 also has a belt cleaner roller 16 for removing toner attached to the belt 15.

Four process units 20 are provided above the belt 13. The process units 20 have four process cartridges 20K, 20Y, 20M, and 20C corresponding to the above-described four colors. Each of the process cartridges 20K to 20C has a developing cartridge (not illustrated) with a toner receiving chamber for receiving the toner (developer) therein and a developing roller 25. The toner is supplied from the toner receiving chamber to the developing roller 25.

Also, each of the process cartridges 20K to 20C has a photosensitive drum 28 and a charger (not illustrated). At the time of forming the image, a surface of the photosensitive drum 28 is charged by the charger, and the charged portion is exposed by the exposing unit, thereby forming an electrostatic latent image on the surface of the photosensitive drum 28.

Then, the toner carried on the developing roller 25 is supplied to the electrostatic latent image on the surface of the photosensitive drum 28, and thus the electrostatic latent image of the photosensitive drum 28 is visualized. After that, the toner image carried on the surface of the respective photosensitive drums 28 is sequentially transferred onto the sheet 3 by a transfer voltage applied to the transfer roller 17, while the sheet 3 passes each nip position between the photosensitive drum 28 and the transfer roller 17.

The sheet 3 on which the toner image is transferred is conveyed to the fixing unit 31 by the belt unit 13. The fixing unit 31 presses and conveys the sheet 3 which is conveyed from the transfer roller 17, to fix the developer image transferred on the sheet 3. The fixing unit 31 has a heating roller 31A with a heat source, and a pressing roller 31B pressing the sheet against the heating roller 31A. While the sheet 3 passes the fixing unit 31, an image forming surface of the sheet 3 is pressed by the heating roller 31A, and thus, the transferred toner image is thermally fixed on the sheet surface. The sheet 3 which is thermally fixed by the fixing unit 31 is conveyed in an upward direction, and then is discharged to an upper surface of the body casing 2 by a discharge roller 33.

Also, the printer 1 includes a sheet reversing mechanism 60 for performing duplex printing. The sheet reversing mechanism 60 includes the discharge roller 33, a reverse conveying path P2 (portion indicated by the dotted-line arrow in FIG. 1), a flapper 61, and a plurality of reverse conveying rollers (DX) 62. In the case of duplex printing, one surface of the sheet 3 is printed by the image forming section 12, and then the sheet 3 is first conveyed to the discharge roller 33. By the reverse rotation of the discharge roller 33, the sheet 3 is conveyed via the flapper 61, the reverse conveying path P2, the plurality of reverse conveying rollers 62, the auxiliary sheet feeding roller 6, and the registration roller 7, and then is conveyed on the belt 15 in a state in which the front surface and the back surface of the sheet 3 are reversed. After the image is printed on the other surface of the sheet 3 by the image forming section 12, the sheet 3 is discharged to the upper surface of the body casing 2.

In addition, the printer 1 includes a plurality of motors for rotating each roller. In the exemplary embodiment the printer 1 includes two motors (a first motor M1 and a second motor M2).

2. Load of Motors

Next, a load (rotator) connected to the first motor M1 and the second motor M2 will be described with reference to FIGS. 2 and 3.

Figure 2:
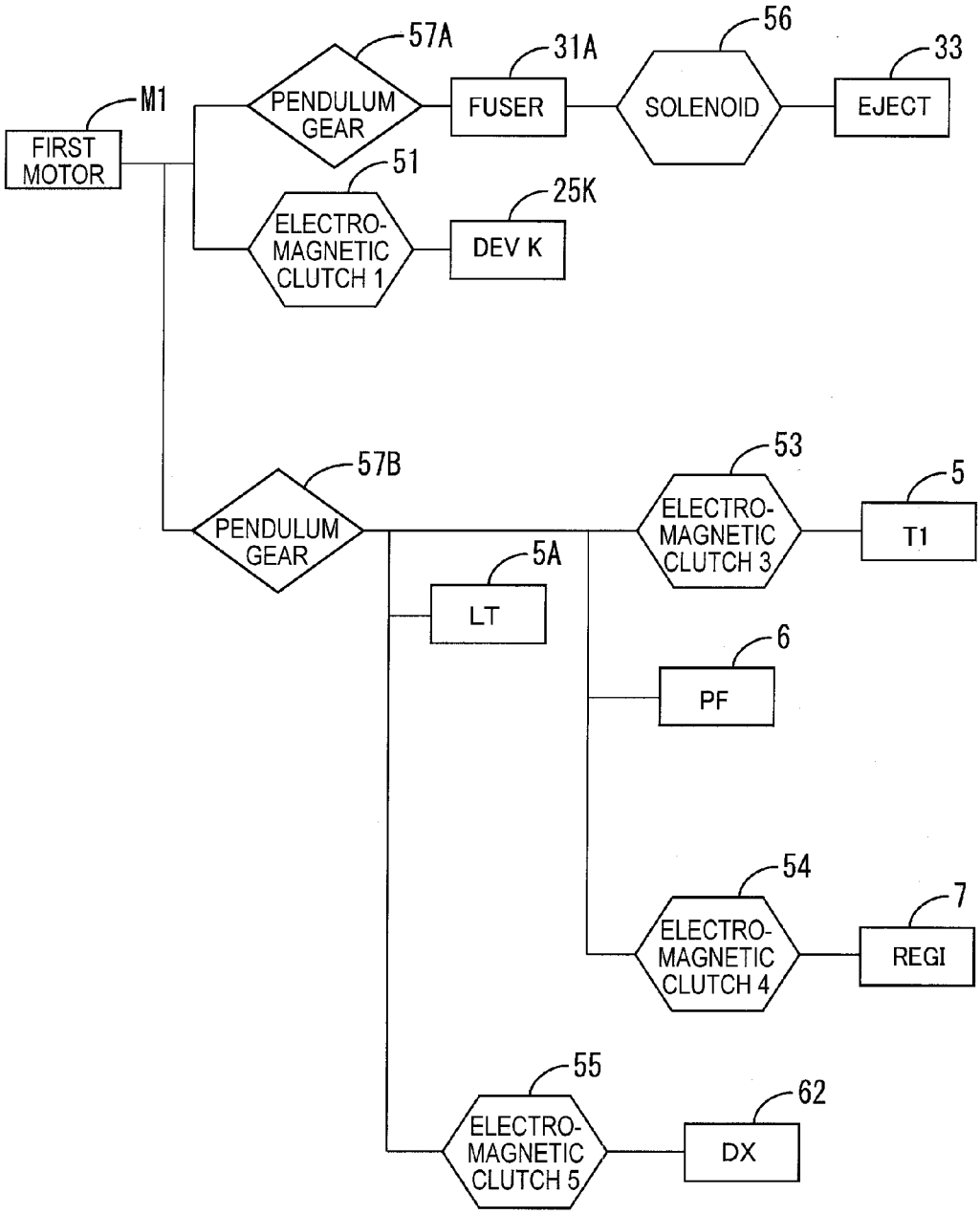
FIG. 2 is a diagram of a load of a first motor.

As illustrated in FIG. 2, the first motor M1 is connected to the heating roller 31A via a first pendulum gear 57A which is a driving mechanism. The rotational power of the heating roller 31A is transmitted to the discharge roller 33 via a solenoid 56.

Also, the driving power of the first motor M1 is transmitted to a black developing roller 25K via a first electromagnetic clutch 51.

The first motor M1 is connected to third, fourth and fifth electromagnetic clutches 53, 54 and 55, the pick-up roller (LT) 5A, and the auxiliary sheet feeding roller (PF) 6 via a second pendulum gear 57*b* which is a driving mechanism.

The driving force of the first motor M1 is transmitted to the pick-up roller (T1) 5 via the third electromagnetic clutch 53, is transmitted to the registration roller 7 via the fourth electromagnetic clutch 54, and is transmitted to the reverse conveying roller (DX) 62 via the fifth electromagnetic clutch 55.

As an example, the auxiliary sheet feeding roller (PF) 6, the heating roller (fixing roller) 31A, the discharge roller 33, and the pick-up roller (LT) 5A correspond to the first rotator. Further, for example, the registration roller 7 and the black developing roller (one example of the developing roller) 25K correspond to the third rotator. In addition, for example, the pick-up roller (T1) 5 and the reverse conveying roller (DX) 62 correspond to the fifth rotator. The developing roller included in the third rotator is not limited to the black developing roller 25K.

The first and fourth electromagnetic clutches 51 and 54 correspond to the first switch. That is, the first and fourth electromagnetic clutches 51 and 54 switch between a connected state in which the driving force of the first motor M1 is transmitted to the third rotator, and a disconnected state in which the driving force of the first motor M1 is not transmitted to the third rotator. Further, the third and fifth electromagnetic clutches 53 and 55 correspond to the third switch. That is, the third and fifth electromagnetic clutches 53 and 55 switch between a connected state in which the driving force of the first motor M1 is transmitted to the fifth rotator, and a disconnected state in which the driving force of the first motor M1 is not transmitted to the fifth rotator.

Figure 3:
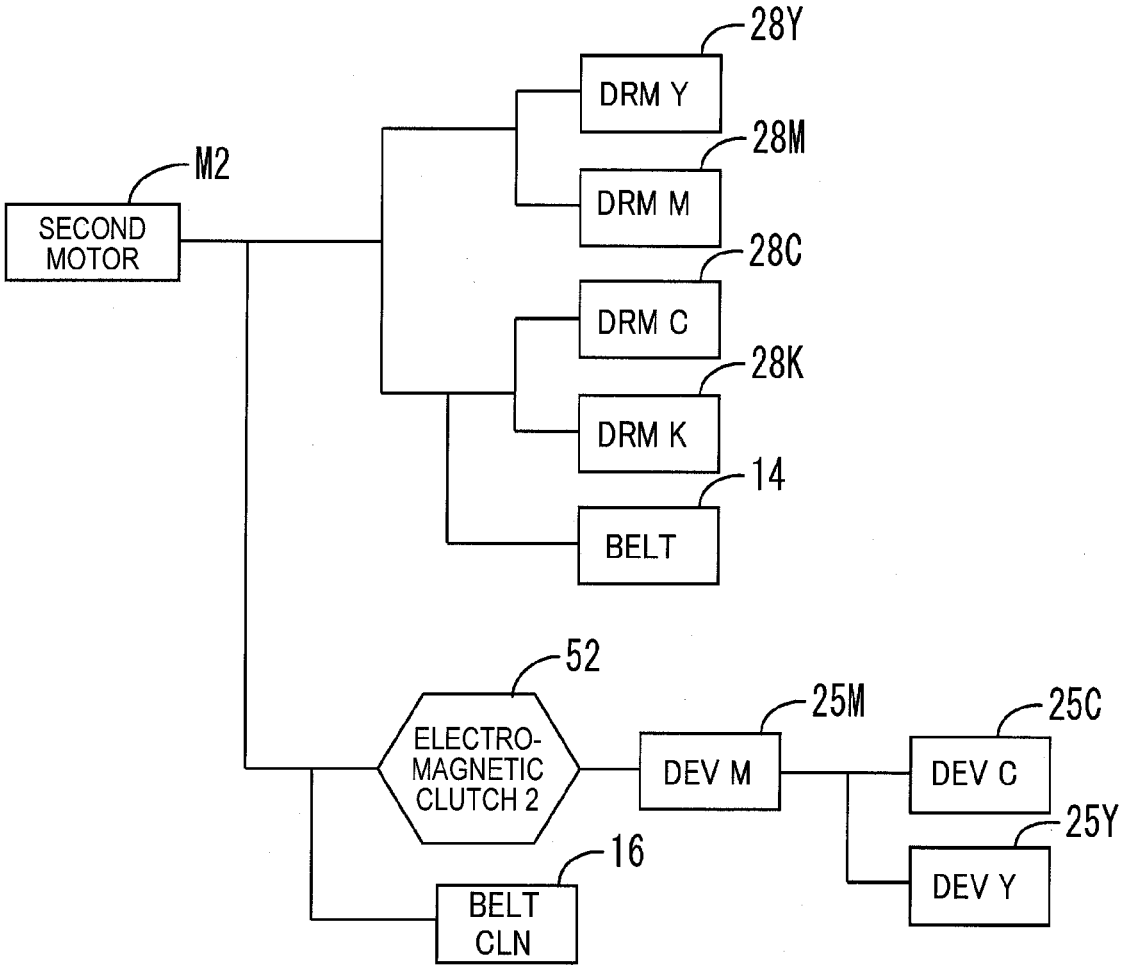
FIG. 3 is a diagram of a load of a second motor.

As illustrated in FIG. 3, the second motor M2 is connected to the photosensitive drums 28Y, 28M, 28C, and 28K for each color, the belt support roller (BELT) 14, and the belt cleaner belt (BELT CLN) 16 via a predetermined driving mechanism (not illustrated). Further, the driving force of the second motor M2 is transmitted to the developing drums 25M, 25C, and 25Y for each color via the second electromagnetic clutch 52.

Herein, for example, the belt support roller (BELT) 14, the belt cleaner roller (BELT CLN) 16, and the photosensitive drums 28Y to 28K correspond to the second rotator. Further, for example, the developing drums 25M, 25C, and 25Y correspond to the fourth rotator.

The second electromagnetic clutch 52 corresponds to the second switch. That is, the second electromagnetic clutch 52 switches between a connected state in which the driving force of the second motor M2 is transmitted to the fourth rotator, and a disconnected state in which the driving force of the second motor M2 is not transmitted to the fourth rotator.

3. Electrical Configuration

Next, the electrical configuration of the printer 1 will be described with reference to FIG. 4.

Figure 4:
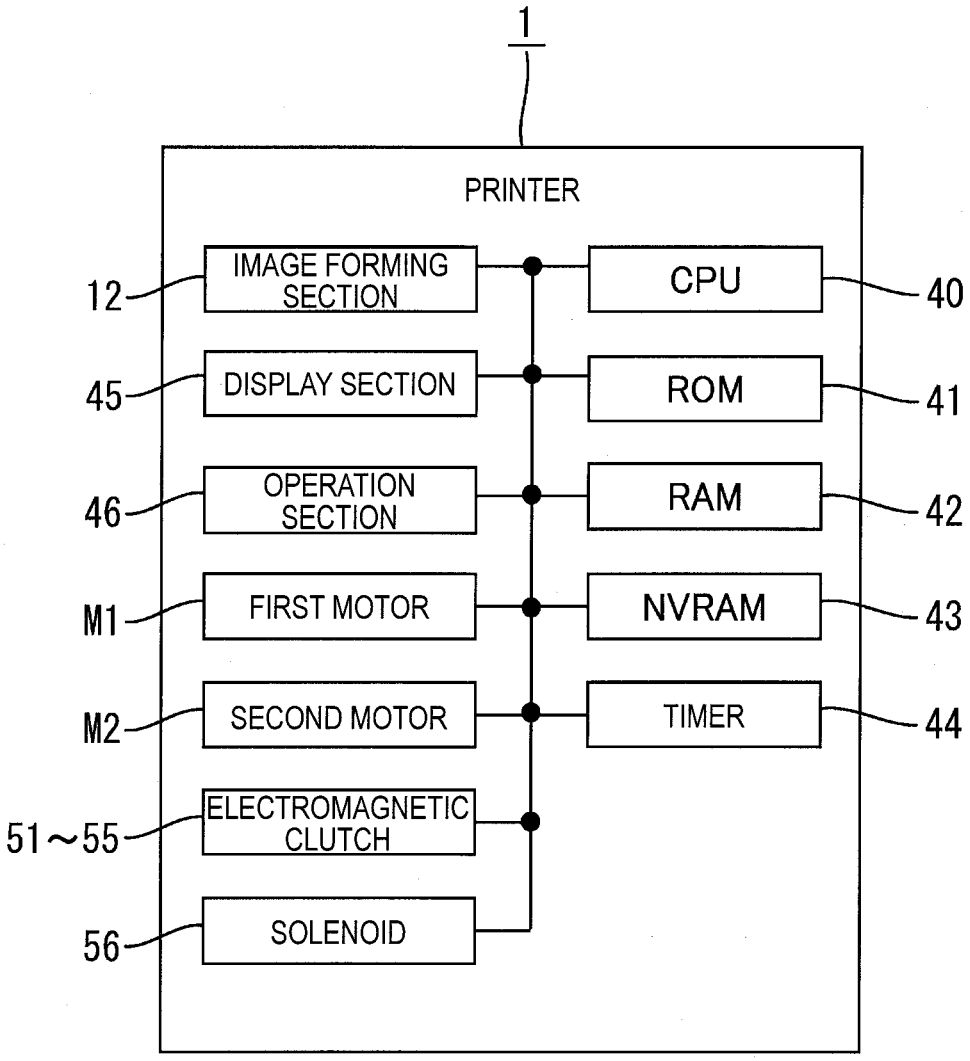
FIG. 4 is a block diagram schematically illustrating an electrical configuration of the printer.

The printer 1 includes, as illustrated in FIG. 4, a CPU 40 (one example of a control device), a ROM 41, a RAM 42, and an NVRAM (not-volatile memory) 43, which are connected to the image forming section 12, a display section 45, an operation section 46, the first motor M1, the second motor M2, the first to fifth electromagnetic clutches 51 to 55, an electromagnetic solenoid 56, and a timer 44. The configuration of the control device is not limited to the CPU 40, and, for example, may be constituted by an ASIC (Application Specific Integrated Circuit).

The display section 45 includes a liquid crystal display and a lamp, and displays various set screens, an operation state of the apparatus, and various warnings. The operation section 46 has a plurality of buttons and a user performs various input operations thereto.

The ROM 41 stores various programs for performing the operation of the printer 1, and the CPU 40 stores the processed result in the RAM 42 or the NVRAM 43 to control the respective sections or units in accordance with the program read by the ROM 41. Further, the ROM 41 stores data of various predetermined times to be used for comparison determination with various measured times measured by the timer 44.

The first and second motors 8 and 9 rotate various rotators via each driving mechanism in accordance with the control of the CPU 40. Further, the switching operation of the first to fifth electromagnetic clutches 51 to 55 and the electromagnetic solenoid 56 is controlled by the CPU 40 at a predetermined timing to connect the loads of the first and second motors 8 and 9.

The CPU 40 controls the respective section or units of the printer 1, and controls the start of the first and second motors 8 and 9 described hereinafter.

4. Start Control Process of Motors

Next, a start control process of the motor will be described with reference to FIG. 5. The start control process of the motor is performed, for example, when an electric power is input to the printer 1. In this instance, each of the start control process of the motor is performed, for example, by the CPU 40 in accordance with a predetermined control program stored in the ROM 41 or the like.

Figure 5:
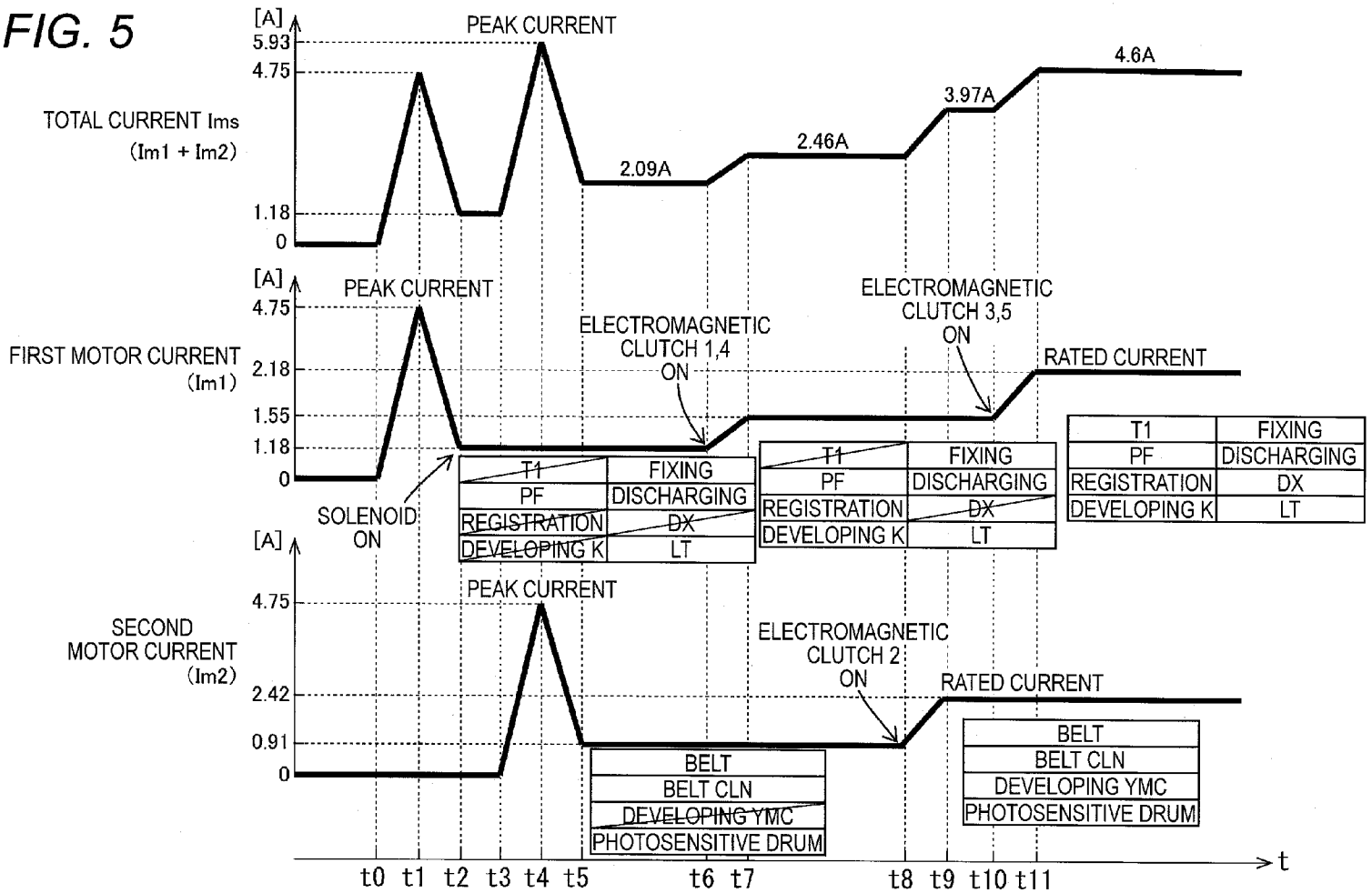
FIG. 5 is a time chart illustrating a transition of a motor current when starting up the motor.

If the electric power is input to the printer 1, the CPU 40 first starts only a rotation of the first motor M1 at a time t0 in FIG. 5 (corresponding to the first rotating process). Then, a first motor current Im1 which is a current of the first motor M1 reaches a peak current of 4.75 A (Ampere), which is a rush current, at a time t1. Then, the first motor current is reduced to 1.181 A, which is a current value corresponding to a connected load, on and after a time t2.

Here, the electric power is not supplied to the first switch, that is, the first and second clutches 51 and 54, and the first and second clutches 51 and 54 are in the disconnected state. Further, the electric power is supplied to the electromagnetic solenoid 56. In this state, as the first motor is rotated, the first rotator, that is, the auxiliary sheet feeding roller (PF) 6, the heating roller (fixing roller) 31A, the discharge roller 33, and the pick-up roller (LT) 5A, are rotated. Further, the discharge roller 33 is rotated in accordance with the rotation of the heating roller 31A. Here, a rotational speed RS1 (corresponding to the first rotational speed) of the first motor M1 is set to be equal to or smaller than a steady rotational speed of the first motor M1. The rotational speed RS1 is, for example, half of the steady rotational speed. Here, the steady rotational speed is a rotational speed when the first motor M1 is normally used.

At a time t3 when the first motor current IM1 is stabilized on and after the time t2, the second motor M2 is rotated (corresponding to the second rotating process). That is, the CPU 40 starts the rotation of the second motor M2 at the start timing t3 which is different from the start timing t0 of the first motor M1.

As illustrated in FIG. 5, a second motor current Im2 which is a current of the second motor M2 reaches the peak current of 4.75 A (Ampere), which is the rush current, at a time t4. Then, the second motor current Im2 is reduced to 0.91 A, which is the current value corresponding to the connected load, after a time t5. At the time t4, the total current Ims of the first motor current Im1 and the second motor current Im2 is 1.18+4.75=5.93 A. The total current Ims after the time t5 is 1.18+0.91-2.09 A.

In the exemplary embodiment, the electric power is not supplied to the second electromagnetic clutch 52 as the second switch, and thus the second electromagnetic clutch 52 is in the disconnected state. In this state, as the second motor M2 is rotated, the belt support roller (BELT) 14, the belt cleaner roller (BELT CLN), and the photosensitive drums 28Y to 28K, which are the second rotator, are rotated. Here, the rotational speed RS2 (corresponding to the second rotational speed) of the second motor M2 is set to be equal to or smaller than the steady rotational speed of the second motor M2. The rotational speed RS2 is set to be, for example, half of the steady rotational speed. Here, the steady rotational speed is a rotational speed when the second motor M2 is normally used.

Then, at a time t6 when the second motor current Im2 is stabilized on or after the time t5, the CPU 40 switches the first and fourth electromagnetic clutches 51 and 54 to the connected state (corresponding to the third rotating process). In this way, the second rotator, that is, the developing roller 25K corresponding to the first electromagnetic clutch 51 and the registration roller 7 corresponding to the fourth electromagnetic clutch 54, is rotated.

As illustrated in FIG. 5, the first motor current IM1 reaches 1.552 A (Ampere) at a time t7. Here, the rotational speed RS of the first motor M1 becomes a rotational speed RS3 (corresponding to the third rotational speed) which is equal to or larger than the rotational speed RS1. The rotational speed RS3 is, for example, equal to or smaller than the steady rotational speed of the first motor M1, and equal to or larger than the half of the steady rotational speed of the first motor M1. Further, the electric power is not supplied to the third switch, that is, the third and fifth electromagnetic clutches 53 and 55, which are in the disconnected state. Here, the total current Ims on or after the time t7 is 1.55+0.91=2.46 A.

Then, at a time t8 when the first motor current Im1 is stabilized on or after the time t7, the CPU 40 switches the second electromagnetic clutch 52 in the connected state (corresponding to the fourth rotating process). In this way, the fourth rotator, that is, the developing drums 25M, 25C, and 25Y, is rotated. Here, as illustrated in FIG. 5, the second motor current Im2 reaches 2.42 A at a time t9. In this instance, the rotational speed RS of the second motor M2 becomes a rotational speed RS4 which is equal to or larger than the second rotational speed RS2. Here, the fourth rotational speed RS4 is the steady rotational speed of the second motor M2. The total current Ims after the time t9 is 1.55+2.42=3.97 A.

Then, at a time t10 when the first motor current Im1 is stabilized on or after the time t9, the CPU 40 switches the third and fifth electromagnetic clutches 53 and 55 in the connected state (corresponding to a fifth rotating process). In this way, the fifth rotator, that is, the pick-up roller (T1) 5 corresponding to the third electromagnetic clutch 53, and the reverse conveying roller (DX) 62 corresponding to the fifth electromagnetic clutch 55, is rotated.

As illustrated in FIG. 5, the first motor current Im1 reaches 2.18 A at the time t11. Here, the rotational speed RS of the first motor M1 becomes a fifth rotational speed RS5 which is equal to or larger than the third rotational speed RS3. The fifth rotational speed RS5 is the steady rotational speed of the first motor M1. The total current Ims on or after the time t11 is 2.18+2.42-4.60 A.

5. Effect of the Exemplary Embodiment

The CPU 40 rotates the first motor M1 in the disconnected state of the first and fourth electromagnetic clutches 51 and 54 (first switch), so that the start timing time t0 of the first rotating process of rotating the first rotator, such as the auxiliary sheet feeding roller (PF), is different from the start timing time t3 of the second rotating process. Further, the CPU performs the second rotating process while performing the first rotating process in which the first motor M1 is in a low load state. For this reason, it is possible to suppress the peak current when the plurality of motors starts.

At the time of starting of first motor M1 and the second motor M2, the motor load is increased in five stages. For this reason, the number of steps of increasing the rotational speed of the motor can be increased, and thus it is possible to reliably suppress generation of the excess current due to abrupt increase in load.

The starting of the second motor M2 and the increase in motor load by connecting the first to third switches are performed at the timing of the state in which the motor currents Im1 and Im2 are stabilized. For this reason, it is possible to reliably perform the starting of the second motor M2 and the increase in load.

Other Embodiments

The present invention is not limited to the above description and the exemplary embodiment illustrated in the accompanying drawings. For example, the following embodiments are also included in the technical scope of the invention.

(1) The above exemplary embodiment illustrates an example in which the first and third switches are provided to increase the load the first motor M1, that is, the first motor current Im1, in two stages, but the present invention is not limited thereto. For example, the third switch may be eliminated, and the first motor current Im1 may be increased in one stage by the first switch. Further, the above exemplary embodiment illustrates the example in which the second switch is provided to increase the load of the second motor M2, that is, the second motor current Im2, in one stage, but the present invention is not limited thereto. The second switch may be eliminated, and the load of the second motor M2, that is, the second motor current Im2, may not be increased in stages.

(2) The above exemplary embodiment illustrates the example in which the rotational speed of the motor is increased from the rotational speed lower than the steady rotational speed to the steady rotational speed in accordance with the procedure of the rotating process, but the present invention is not limited thereto. For example, the third rotational speed RS3 may be the steady rotational speed, that is, the third rotational speed RS3 may be equal to the fifth rotational speed RS5.

(3) The contents of the first to fifth rotators is not limited to the example illustrated in the exemplary embodiment, and may be appropriately set. Further, the number of motors is not limited to two. In addition, the order of the starting of the first motor M1 and the second motor M2 is not limited to the example illustrated in the exemplary embodiment. That is, the second motor M2 may be started earlier than the first motor M1.

(4) The third rotator may include an upstream rotator and a downstream rotator which is positioned at a downstream side in the sheet conveying direction than the upstream rotator. The first switch may be configured to respectively switch the upstream rotator and the downstream rotator between the connected state and the disconnected state. In the third rotating process, the CPU 40 (control device) may switch the downstream rotator in the connected state after switching the upstream rotator in the connected state, while rotating the first motor M1. For example, after the registration roller 7 is switched to the connected state by the first switch, the developing roller 25K (downstream rotator) may be switched to the connected state.

Here, since a timing at which the downstream rotator is used is later than the timing at which the upstream rotator is used, it is possible to suppress the image forming operation from being delayed.

The present invention provides illustrative, non-limiting aspects as follows:

(1) In a first aspect, there is provided an image forming apparatus including: an image forming section; a first rotator, a second rotator, and a third rotator; a first motor; a second motor; a first switch; and a control device. The image forming section is configured to form an image on a sheet. The first rotator, the second rotator, and the third rotator are configured to be rotated in accordance with an image forming operation of the image forming section. The first motor is configured to drive the first rotator and the third rotator. The second motor is configured to drive the second rotator. The first switch is configured to switch between a connected state in which a driving force from the first motor is transmitted to the third rotator, and a disconnected state in which the driving force from the first motor is not transmitted to the third rotator. The control device is configured to: perform a first rotating process of rotating the first rotator by rotating the first motor in the disconnected state, perform a second rotating process of rotating the second rotator by rotating the second motor, and perform a start timing process of providing a difference between a start timing of the first rotating process and a start timing of the second rotating process.

Accordingly, since a difference is provided between the start timing of the first rotating process and the start timing of the second rotating process, and the second rotating process is performed while the first rotating process is performed in a state in which the first switch is in the disconnected state and the first motor is in a low load state, it is possible to suppress the peak current when the plurality of motors are started.

(2) In a second aspect, there is provided the image forming apparatus according to the first aspect, wherein the control device is further configured to: perform a third rotating process of rotating the third rotator by rotating the first motor in the connected state, and perform the first to third rotating processes in an order of the first rotating process, the second rotating process, and the third rotating process.

Accordingly, the motor load can be increased to a predetermined load in stages. For this reason, it is possible to avoid a problem caused by the load abruptly increased, while decreasing a peak value of the motor load (motor current).

(3) In a third aspect, there is provided the image forming apparatus according to claim the first or second aspect, wherein the control device is further configured to: start performing the second rotating process after a current of the first motor is stabilized.

Accordingly, if the second motor starts up in a state in which the current of the first motor is not stable, that is, during a transition period of the starting of the first motor, a bad influence will be exerted on the starting of the respective motors. For this reason, the second rotating process is performed after the current of the first motor is stabilized. That is, as the second motor starts after the first motor is stabilized, the starting of the respective motors can be reliably performed.

(4) in a fourth aspect, there is provided the image forming apparatus according to the second or third aspect, wherein the control device is further configured to: start performing the third rotating process after a current of the second motor is stabilized.

Accordingly, if the first motor starts up in the state in which the current of the second motor is not stable, that is, during the transition period of the starting of the second motor, the bad influence will be exerted on the respective motors. For this reason, according to the configuration, the third rotating process is performed after the current of the second motor is stabilized. That is, as the first motor starts after the second motor is stabilized, the starting of the respective motors can be reliably performed.

(5) In a fifth aspect, there is provided the image forming apparatus according to any one of the second to fourth aspects, wherein the third rotator includes an upstream rotator and a downstream rotator which is positioned at a downstream side in a sheet conveying direction than the upstream rotator, wherein the first switch is configured to respectively switch the upstream rotator and the downstream rotator between the connected state and the disconnected state, and wherein, in the third rotating process, the downstream rotator is switched to the connected state after the upstream rotator is switched to the connected state, while rotating the first motor.

Accordingly, since the timing at which the downstream rotator is used is slower than the timing at which the upstream rotator is used, it is possible to suppress the image forming operation from being delayed.

(6) In a sixth aspect, there is provided the image forming apparatus according to any one of the second to fifth aspects, wherein the third rotator includes a developing roller, and wherein the first switch is an electromagnetic clutch.

Accordingly, as compared with a case where the developing roller starts rotating from the starting of the motor, the rotating time (use time) of the developing roller can be reduced, thereby extending a lifetime of the developing roller.

(7) In a seventh aspect, there is provided The image forming apparatus according to any one of the second to sixth aspects, wherein the control device is further configured to: perform the first rotating process at a first rotational speed, and perform the third rotating process at a third rotational speed equal to or larger than the first rotational speed.

Accordingly, since the motor current increases as the rotational speed of the motor increases, it is possible to further suppress the peak current when the plurality of motors start by making the rotational speed of the motor at the time of the starting of the motor to be low.

(8) In an eighth aspect, there is provided the image forming apparatus according to any one of the second to seventh aspects, further including: a fourth rotator configured to be rotated in accordance with the image forming operation of the image forming section; and a second switch configured to switch between a connected state in which a driving force from the second motor is transmitted to the fourth rotator, and a disconnected state in which the driving force from the second motor is not transmitted to the fourth rotator, wherein the control device is further configured to: perform the second rotating process at a second rotational speed while the second switch is in the disconnected state, and perform a forth rotating process of rotating the fourth rotator by rotating the second motor at a fourth rotational speed which is equal to or larger than the second rotational speed while the second switch is in the connected state, after performing the third rotating process.

Accordingly, since the motor current after starting the second motor is low, the total current of the first motor and the second motor just after the motor starts can be lowered. In this way, the total current can be reliably increased in stages.

(9) In a ninth aspect, there is provided the image forming apparatus according to the eighth aspect, further including a fifth rotator configured to be rotated in accordance with the image forming operation of the image forming section; and a third switch configured to switch between a connected state in which the driving force from the first motor is transmitted to the fifth rotator, and a disconnected state in which the driving force from the first motor is not transmitted to the fifth rotator, wherein the control device is further configured to: perform the third rotating process at a third rotational speed while the third switch is in the disconnected state, and perform a fifth rotating process of rotating the fifth rotator by rotating the first motor at a fifth rotational speed which is equal to or larger than the third rotational speed while the third switch is in the connected state, after performing the fourth rotating process.

Accordingly, since the load of the first motor is increased in stages, the number of stages of increasing the rotational speed can be increased. In this way, it is possible to reliably suppress generation of excessive current due to the abrupt increase in load.

What is claimed is:

1. An image forming apparatus comprising:

an image forming section configured to form an image on a sheet;

a first rotator;

a second rotator;

a third rotator including an upstream rotator and a downstream rotator which is positioned at a downstream side in a sheet conveying direction than the upstream rotator, the first, second and third rotators being configured to be rotated in accordance with an image forming operation of the image forming section;

a first motor configured to drive the first rotator and the third rotator;

a second motor configured to drive the second rotator;

a first switch configured to switch between a connected state in which a driving force from the first motor is transmitted to the third rotator, and a disconnected state in which the driving force from the first motor is not transmitted to the third rotator, wherein switching between the connected state and the disconnected state includes the first switch respectively switching the upstream rotator and the downstream rotator between the connected state and the disconnected state; and a control device configured to:

perform a first rotating process of rotating the first rotator by rotating the first motor in the disconnected state, perform a second rotating process of rotating the second rotator by rotating the second motor, perform a start timing process of providing a difference between a start timing of the first rotating process and a start timing of the second rotating process, and perform a third rotating process of rotating the third rotator by rotating the first motor in the connected state, wherein, in the third rotating process, the downstream rotator is switched to the connected state after the upstream rotator is switched to the connected state, while rotating the first motor, wherein the first, second and third rotating processes are performed in an order of the first rotating process, the second rotating process, and the third rotating process.

2. The image forming apparatus according to claim 1, wherein the control device is further configured to:

start performing the second rotating process after a current of the first motor is stabilized.

3. The image forming apparatus according to claim 1, wherein the control device is further configured to:

start performing the third rotating process after a current of the second motor is stabilized.

4. The image forming apparatus according to claim 1, wherein the third rotator includes a developing roller, and wherein the first switch is an electromagnetic clutch.

5. The image forming apparatus according to claim 1, wherein the control device is further configured to:

perform the first rotating process at a first rotational speed, and perform the third rotating process at a third rotational speed equal to or larger than the first rotational speed.

6. The image forming apparatus according to claim 1, further comprising:

a fourth rotator configured to be rotated in accordance with the image forming operation of the image forming section; and a second switch configured to switch between a connected state in which a driving force from the second motor is transmitted to the fourth rotator, and a disconnected state in which the driving force from the second motor is not transmitted to the fourth rotator, wherein the control device is further configured to:

perform the second rotating process at a second rotational speed while the second switch is in the disconnected state, and perform a fourth rotating process of rotating the fourth rotator by rotating the second motor at a fourth rotational speed which is equal to or larger than the second rotational speed while the second switch is in the connected state, after performing the third rotating process.

7. The image forming apparatus according to claim 6, further comprising:

a fifth rotator configured to be rotated in accordance with the image forming operation of the image forming section; and a third switch configured to switch between a connected state in which the driving force from the first motor is transmitted to the fifth rotator, and a disconnected state in which the driving force from the first motor is not transmitted to the fifth rotator, wherein the control device is further configured to:

perform the third rotating process at a third rotational speed while the third switch is in the disconnected state, and perform a fifth rotating process of rotating the fifth rotator by rotating the first motor at a fifth rotational speed which is equal to or larger than the third rotational speed while the third switch is in the connected state, after performing the fourth rotating process.

8. The image forming apparatus according to claim 1, further comprising:

a fourth rotator configured to be rotated in accordance with the image forming operation of the image forming section; and a second switch configured to switch between a connected state in which a driving force from the second motor is transmitted to the fourth rotator, and a disconnected state in which the driving force from the second motor is not transmitted to the fourth rotator, wherein the control device is further configured to:

perform the second rotating process at a second rotational speed while the second switch is in the disconnected state, and perform a fourth rotating process of rotating the fourth rotator by rotating the second motor at a fourth rotational speed which is equal to or larger than the second rotational speed while the second switch is in the connected state, after performing the third rotating process.

9. The image forming apparatus according to claim 8, further comprising:

a fifth rotator configured to be rotated in accordance with the image forming operation of the image forming section; and a third switch configured to switch between a connected state in which the driving force from the first motor is transmitted to the fifth rotator, and a disconnected state in which the driving force from the first motor is not transmitted to the fifth rotator, wherein the control device is further configured to:

perform the third rotating process at a third rotational speed while the third switch is in the disconnected state, and perform a fifth rotating process of rotating the fifth rotator by rotating the first motor at a fifth rotational speed which is equal to or larger than the third rotational speed while the third switch is in the connected state, after performing the fourth rotating process.

10. An image forming apparatus comprising:

an image forming section configured to form an image on a sheet;

a first rotator;

a second rotator;

a third rotator including a developing roller, the first, second and third rotators being configured to be rotated in accordance with an image forming operation of the image forming section;

a first motor configured to drive the first rotator and the third rotator;

a second motor configured to drive the second rotator;

a first switch, including an electromagnetic clutch, configured to switch between a connected state in which a driving force from the first motor is transmitted to the third rotator, and a disconnected state in which the driving force from the first motor is not transmitted to the third rotator; and a control device configured to:

perform a first rotating process of rotating the first rotator by rotating the first motor in the disconnected state, perform a second rotating process of rotating the second rotator by rotating the second motor, perform a start timing process of providing a difference between a start timing of the first rotating process and a start timing of the second rotating process, and perform a third rotating process of rotating the third rotator by rotating the first motor in the connected state, wherein the first, second and third rotating processes are performed in an order of the first rotating process, the second rotating process, and the third rotating process.

11. The image forming apparatus according to claim 10, wherein the control device is further configured to start performing the second rotating process after a current of the first motor is stabilized.

12. The image forming apparatus according to claim 10, wherein the control device is further configured to start performing the third rotating process after a current of the second motor is stabilized.

13. The image forming apparatus according to claim 10, wherein the control device is further configured to:

perform the first rotating process at a first rotational speed, and perform the third rotating process at a third rotational speed equal to or larger than the first rotational speed.

14. An image forming apparatus comprising:

an image forming section configured to form an image on a sheet;

a first rotator;

a second rotator;

a third rotator;

a fourth rotator, the first, second, third and fourth rotators being configured to be rotated in accordance with an image forming operation of the image forming section;

a first motor configured to drive the first rotator and the third rotator;

a second motor configured to drive the second rotator;

a first switch configured to switch between a connected state in which a driving force from the first motor is transmitted to the third rotator, and a disconnected state in which the driving force from the first motor is not transmitted to the third rotator;

a second switch configured to switch between a connected state in which a driving force from the second motor is transmitted to the fourth rotator, and a disconnected state in which the driving force from the second motor is not transmitted to the fourth rotator; and a control device configured to:

perform a first rotating process of rotating the first rotator by rotating the first motor in the disconnected state, perform a second rotating process of rotating the second rotator by rotating the second motor, wherein the second rotating process is performed at a second rotational speed while the second switch is in the disconnected state, perform a start timing process of providing a difference between a start timing of the first rotating process and a start timing of the second rotating process, perform a third rotating process of rotating the third rotator by rotating the first motor in the connected state, wherein the first, second and third rotating processes are performed in an order of the first rotating process, the second rotating process, and the third rotating process, and perform a fourth rotating process of rotating the fourth rotator by rotating the second motor at a fourth rotational speed which is equal to or larger than the second rotational speed while the second switch is in the connected state, after performing the third rotating process.

15. The image forming apparatus according to claim 14, wherein the control device is further configured to start performing the second rotating process after a current of the first motor is stabilized.

16. The image forming apparatus according to claim 14, wherein the control device is further configured to start performing the third rotating process after a current of the second motor is stabilized.

17. The image forming apparatus according to claim 14, wherein the control device is further configured to:

perform the first rotating process at a first rotational speed, and perform the third rotating process at a third rotational speed equal to or larger than the first rotational speed.

* * * * *